US005908253A

United States Patent [19]

Sutter

[11] Patent Number: 5,908,253

[45] Date of Patent: Jun. 1, 1999

[54] HAND-HELD TOOL FOR PREPARING SURFACES OF TUBING AND FITTINGS

[76] Inventor: Joseph F. Sutter, 432 S. Broadway, Wind Gap, Pa. 18091

[21] Appl. No.: 08/919,246

[22] Filed: Aug. 28, 1997

[51] Int. Cl.[6] ..... A46B 15/00

[52] U.S. Cl. ..... 401/9; 401/10

[58] Field of Search ..... 401/9, 10, 155, 401/161, 169

[56] References Cited

U.S. PATENT DOCUMENTS

| | | | |
|---|---|---|---|
| 695,945 | 3/1902 | Pfeifer . | |
| 1,542,925 | 6/1925 | Wambold | 401/155 |
| 2,862,211 | 12/1958 | Hume | 15/258 |
| 3,851,617 | 12/1974 | Usab | 118/3 |
| 3,889,628 | 6/1975 | Usab | 401/9 |
| 4,133,070 | 1/1979 | Litt | 15/106 |
| 4,862,549 | 9/1989 | Criswell et al. | 15/104.04 |
| 4,899,409 | 2/1990 | Cox, Jr. | 7/167 |
| 5,044,803 | 9/1991 | Kurosawa et al. | 401/9 |
| 5,222,821 | 6/1993 | Osborne et al. | 401/9 |
| 5,269,104 | 12/1993 | DiBiagio | 51/170 |
| 5,307,534 | 5/1994 | Miller | 15/4 |
| 5,493,748 | 2/1996 | Santo | 15/104.04 |

*Primary Examiner*—David J. Walczak

*Attorney, Agent, or Firm*—Caesar, Rivise, Bernstein, Cohen & Pokotilow, Ltd.

[57] ABSTRACT

A hand-held tool and method for cleaning the surfaces of tubing and fittings then applying flux to the cleaned surfaces. The hand-held tool includes an elongated casing which has a longitudinal axis, first and second ends, and a chamber between the first and second ends of the casing. A removable cartridge which contains a flux and has an orifice for discharge of the flux from the cartridge is disposed within the chamber. A cleaning brush is affixed to the first end of the casing. The tool also includes dispensing means for dispensing the flux from the cartridge and transmitting means in communication with the orifice of the cartridge for transmitting the dispensed flux from the cartridge to a flux applicator. The flux applicator is connected to the transmitting means adjacent the second end of the casing. Holding the tool in one hand, the operator cleans the surfaces of the tubing or fittings with the cleaning brush affixed to the first end of the casing. The operator then dispenses the flux from the cartridge, the dispensed flux being transmitted to the flux applicator. The operator then applies the dispensed flux from the flux applicator onto the clean surfaces of the tubing or the fittings.

20 Claims, 3 Drawing Sheets

HAND-HELD TOOL FOR PREPARING SURFACES OF TUBING AND FITTINGS

FIELD OF THE INVENTION

The invention pertains to a tool and method for preparing the surfaces of tubing and fittings, and more particularly, to a hand-held tool that combines in one unit the means for first cleaning the surfaces then applying flux to the cleaned surfaces of tubing and fittings.

BACKGROUND OF THE INVENTION

Copper tubing and fittings are used for plumbing in many buildings. The tubing typically comes in ten-foot lengths, which are usually ½" or ¾" in diameter, but may be ⅜", 1" or other diameters. The fittings include elbows and tees. Lengths of tubing and fittings are joined by soldering the joints.

Soldering is a method of joining metals together using a layer of alloy which is applied when molten and then solidifies on cooling. Plumbing work uses soft solder, an alloy of tin and silver with a low melting point.

Soldering requires that mating surfaces of the tubing and/or fittings be free of contaminants, oxides, or other obstructing films so that the surfaces will readily accept the solder. This is required to form sound joints which are free of porosity and voids and which do not leak.

It is common practice, therefore, to clean the outer surfaces of the ends of tubing and the inner surfaces of fittings which will receive the solder. A soldering flux (soldering paste) also is applied to the cleaned surface before soldering. Soldering flux is a chemical substance which aids the flow of solder and serves to remove and prevent the formation of oxides on the pieces to be united by soldering. (A "flux", as used herein, may be any flowable product, such as coatings, pastes, and other flowable products used not only in soldering but in other applications, including but not limited to welding, brazing, glazing, painting, and other such applications.)

Soldering flux is available normally in paste form and is supplied in metal cans containing about two (2) ounces of flux. A small brush (similar to a painting brush) may be used to apply the flux to the external surface or internal surface of the tubing or fitting to be soldered.

Wire brushes usually are used to clean the surfaces before applying the flux. However, sandpaper, steel wire pads, dry steel wool, or emery cloth may be used rather than wire brushes.

Various tools incorporating brushes have been developed to perform the required cleaning operation. Examples of such tools are disclosed in U.S. Pat. Nos. 4,133,070; 4,862,549; 5,269,104; 5,307,534; 5,493,748; and 4,899,409. However, those tools do not include means for dispensing and applying flux (i.e., "fluxing") onto the surfaces of the tubing or fittings after cleaning or prior to soldering.

Conventional cleaning and fluxing of many tubing and fitting joint components can become tedious and time-consuming, which may lead to inattention and error by plumbers. A tool which would enable a plumber to complete the tasks of cleaning and applying flux more quickly and effectively could eliminate tedium and increase safety. For example, having the ability to complete these operations more quickly and effectively would decrease the likelihood of a plumber knocking over his soldering torch, which is set down during cleaning and fluxing operations.

It is desired to have a hand-held tool which combines in one unit the means for quickly and effectively cleaning and fluxing the surfaces of tubing and fittings. It also is desired to have separate tools of this type for various sizes of tubing (e.g., 1", ¾", ½", and ⅜").

SUMMARY OF THE INVENTION

The present invention is a hand-held tool for preparing the outside or inside surfaces of tubing and fittings. It combines in one unit the means for first cleaning the surfaces and then applying flux to the clean surfaces of tubing and fittings.

The hand-held tool includes an elongated casing which has a longitudinal axis, first and second ends, and a chamber between the first and second ends of the casing. A removable cartridge which contains a flux and has an orifice for discharge of the flux from the cartridge is disposed within the chamber. A cleaning brush is affixed to the first end of the casing. The tool also includes dispensing means for dispensing the flux from the cartridge and transmitting means in communication with the orifice of the cartridge for transmitting the dispensed flux from the cartridge to a flux applicator. The flux applicator is connected to the transmitting means adjacent the second end of the casing.

In one embodiment, the hand-held tool is designed to prepare the outside surfaces of tubing and fittings; and in a second embodiment, the hand-held tool is designed to prepare the inside surfaces of tubing and fittings. In the first embodiment, the cleaning brush is an annular brush adapted to clean the outside surfaces of the tubing or fittings. In the second embodiment, the cleaning brush is a tubular brush adapted to clean the inside surfaces of the tubing or fittings.

The first embodiment also may be equipped with a device for removing burrs. The deburring device is mounted adjacent the annular cleaning brush.

The flux applicator may comprise a plurality of pads adapted to apply dispensed flux onto the surface of a tubing or a fitting. The pads may be made of a flexible, porous material such as felt, woven fabric, or carpet-like nap material.

Although the elongated casing may be made in various shapes, it is substantially cylindrical in the preferred embodiment. The flux applicator in the preferred embodiment includes three (3) pads each located substantially 120° apart from the other pads relative to the longitudinal axis of the casing.

In the preferred embodiment, the cartridge has a collapsible outer surface and the dispensing means comprises a movable member. When the member is moved into contact with the collapsible outer surface of the cartridge, some of the flux is forced out of the orifice and into the transmitting means.

In the preferred embodiment, there is a channel in the casing, which channel extends substantially the length of the chamber and is in communication with the chamber. The movable member in this embodiment is a roller disposed in the chamber and a lever having first and second ends. The first end of the lever is attached to the roller and the second end of the lever extends through the channel to the outer circumference of the casing. Movement of the second end of the lever results in a corresponding movement of the roller within the chamber.

The cleaning brushes, whether annular or tubular, are wire brushes in the preferred embodiment.

A removable cover attachable to the second end of the casing may be provided to cover the flux applicator when the flux applicator is not in use.

Also, at least one end of the casing may be removable to provide access to the chamber for insertion and removal of the removable cartridge.

Although the casing of the preferred embodiment is substantially cylindrical, the outer circumference of the casing has a planar surface over approximately 10–30% of the outer circumference. This planar surface extends at least 40% of the length of the casing substantially parallel to the longitudinal axis of the casing. The purpose of the planar surface is to prevent the tool from rolling when it is set down by the operator.

Finally, the method of using the hand-held tool to prepare the outside or inside surfaces of tubing or fittings is also part of the present invention. The first step of the method is for the operator to hold the hand-held tool described above. Next, the operator cleans the surfaces of the tubing or fittings with the cleaning brush affixed to the first end of the casing. The operator then dispenses the flux from the cartridge, the dispensed flux being transmitted to the flux applicator. The operator then applies the dispensed flux from the flux applicator onto the clean surfaces of the tubing or the fittings.

The foregoing and other features and advantages of the present invention will become more apparent in light of the following detailed description of the preferred embodiments thereof, as illustrated in the accompanying figures.

BRIEF DESCRIPTION OF THE DRAWINGS

For a better understanding of the present invention, reference is made to the accompanying drawings. The drawings show a preferred embodiment of the invention for preparation of external surfaces and a preferred embodiment of the invention for preparing internal surfaces. However, it should be understood that the invention is not limited to the precise arrangements and instrumentalities shown in the drawings.

DETAILED DESCRIPTION OF THE INVENTION

Figure 1:
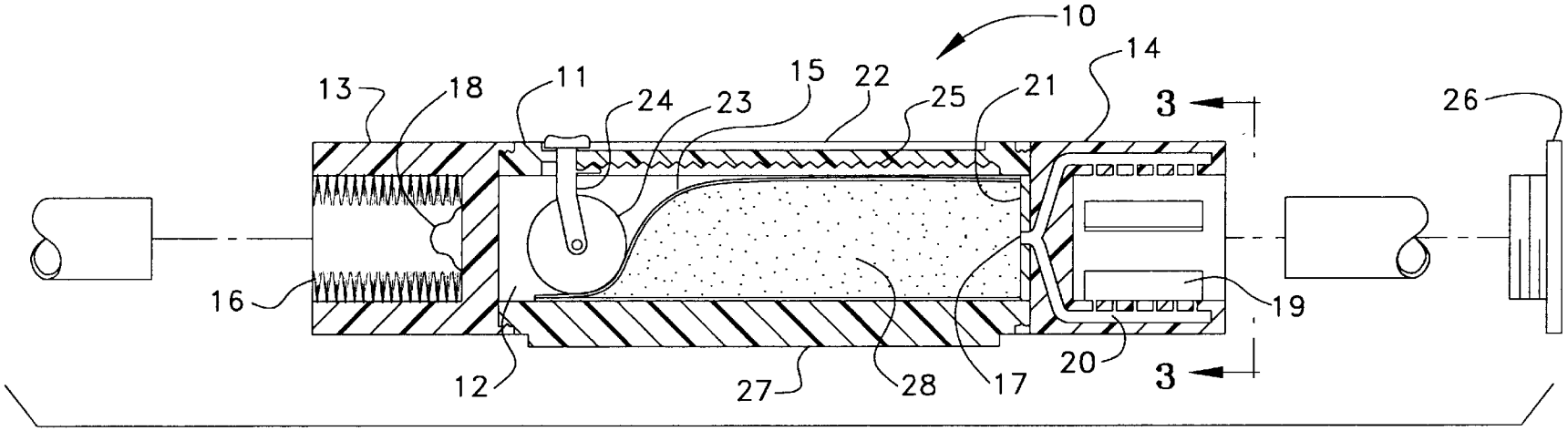
FIG. 1 is a cross-sectional view of an embodiment of the present invention for preparing external surfaces of tubing or fittings.
Figure 2:
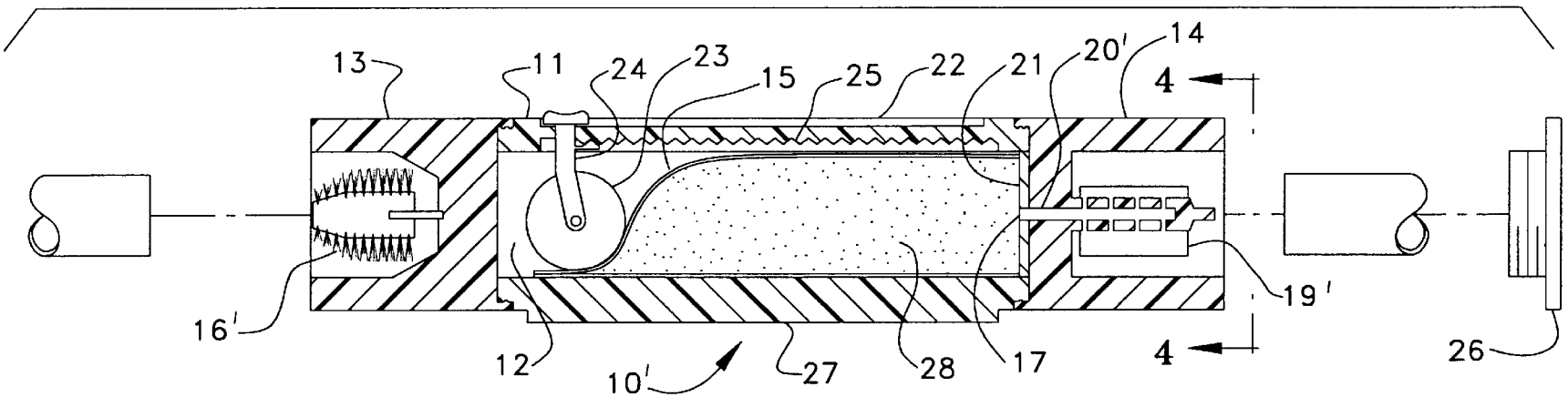
FIG. 2 is a cross-sectional view of an embodiment of the present invention for preparing internal surfaces of tubing or fittings.
Figure 3:
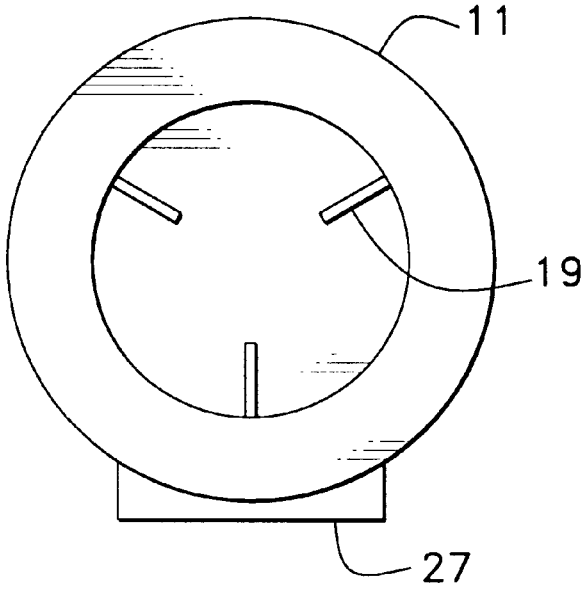
FIG. 3 is an end view taken along the lines 3—3 in FIG. 1.
Figure 4:
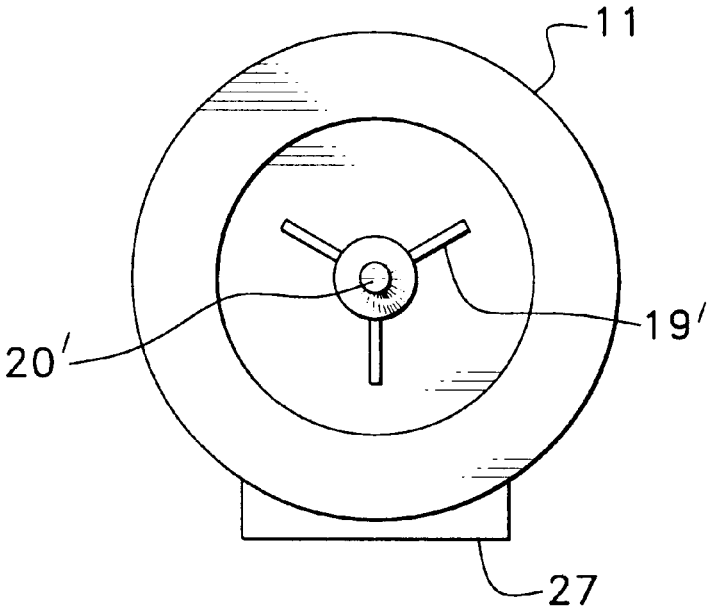
FIG. 4 is an end view taken along the lines 4—4 in FIG. 2.

Referring now to the drawings, where like elements are identified by like numerals, there is shown in FIGS. 1 and 3 a preferred embodiment of a hand-held tool for preparing the outside of tubing and fittings for soldering designated by reference 10. FIGS. 2 and 4 show a preferred embodiment of a hand-held tool for preparing the inside surface of tubing and fittings for soldering designated by reference 10'.

Both embodiments of the hand-held tool comprise an elongated casing 11 which has a longitudinal axis, first and second ends, and a chamber 12 between the first end 13 and the second end 14 of the casing. A removable cartridge 15 which contains a flux 28 and has an orifice 17 for discharge of the flux from the cartridge is disposed within the chamber 12. A cleaning brush 16 is affixed to the first end 13 of the casing 11. The tool also includes dispensing means for dispensing the flux 28 from the cartridge 15 and transmitting means in communication with the orifice 17 of the cartridge for transmitting the dispensed flux from the cartridge to a flux applicator. The flux applicator is connected to the transmitting means adjacent the second end 14 of the casing 11.

In the embodiment 10 shown in FIGS. 1 and 3, the cleaning brush 16 is an annular wire brush adapted to clean the outside surfaces of the tubing or fittings to be prepared for soldering. In the embodiment 10', the cleaning brush 16' is a tubular wire brush adapted to clean the inside surfaces of the tubing or fittings being prepared for soldering.

The embodiment 10 shown in FIG. 1 also is equipped with a deburring device 18 mounted adjacent the annular cleaning brush 16.

The flux applicator comprises a plurality of pads (19, 19') adapted to apply dispensed flux onto the surface of a tubing or a fitting upon which solder is to be applied. The pads (19, 19') may be made of a flexible, porous material such as a felt, woven fabric, or a carpet-like nap material.

Although the elongated casing 11 may be made in various shapes, it is substantially cylindrical in the preferred embodiment. The flux applicator in the preferred embodiment includes three (3) pads (19, 19') each located substantially 120° apart from the other pads relative to the longitudinal axis of the casing 11.

In the preferred embodiment 10 illustrated in FIG. 3, the pads 19 are connected to conduits 20 which transmit the flux 28 from the cartridge 15 to the pads. The conduits 20 are located at the inner circumference of the casing 11 and are substantially 120° apart from each other.

In the preferred embodiment 10' illustrated in FIGS. 2 and 4, the pads 19' are connected to a single conduit 20' which transmits dispensed flux from the cartridge 15 to the pads. The conduit 20' is located substantially along the longitudinal axis of the casing 11. The three pads 19' are substantially 120° apart from each other relative to the longitudinal axis of the casing 11.

In the preferred embodiment, the cartridge 15 has a collapsible outer surface and the dispensing means comprises a movable member. When the member is moved into contact with the collapsible outer surface of the cartridge, some of the flux is forced out of the orifice 17 and into the transmitting means. A retaining shield 21 maintains the cartridge in a stationary position when the member is moved.

In the preferred embodiment, there is a channel 22 in the casing 11, which channel extends substantially the length of the chamber 12 and is in communication with the chamber. The movable member in the preferred embodiment is a roller 23 disposed in the chamber 12 and a lever 24 having first and second ends. The first end of the lever 24 is attached to the roller 23 and the second end of the lever extends through the channel 22 to the outer circumference of the casing 11. Movement of the second end of the lever 24 results in a corresponding movement of the roller 23 within the chamber 12.

A series of notches 25 in the channel 22 engage the lever 24. When the operator desires to dispense more flux 28, the lever 24 is moved forward to the desired position and is engaged with a notch 25 at that position.

The operator activates the lever 24 by pressing his thumb or any other finger against the top of the lever 24.

A removable cover 26 attachable to the second end 14 of the casing 11 may be provided to cover the flux applicator when the flux applicator is not in use.

One or both ends (13, 14) of the casing 11 may be removable to provide access to the chamber 12. The second end 14 is removable in the preferred embodiment to allow for insertion and removal of the removable cartridge 15.

Although the casing 11 of the preferred embodiment is substantially cylindrical, the outer surface of the casing has a planar surface 27 over approximately 10–30% of the outer circumference of the casing. This planar surface 27 extends at least 40% of the length of the casing 11 substantially parallel to the longitudinal axis of the casing. The purpose of the planar surface 27 is to prevent the tool (10, 10') from rolling when it is set down by the operator.

However, it is not necessary to include the planar surface 27. The hand-held tool may have an elongated casing 11 which is cylindrical, substantially cylindrical, or any other elongated shape which may be conveniently held in the operator's hand.

Figure 5:
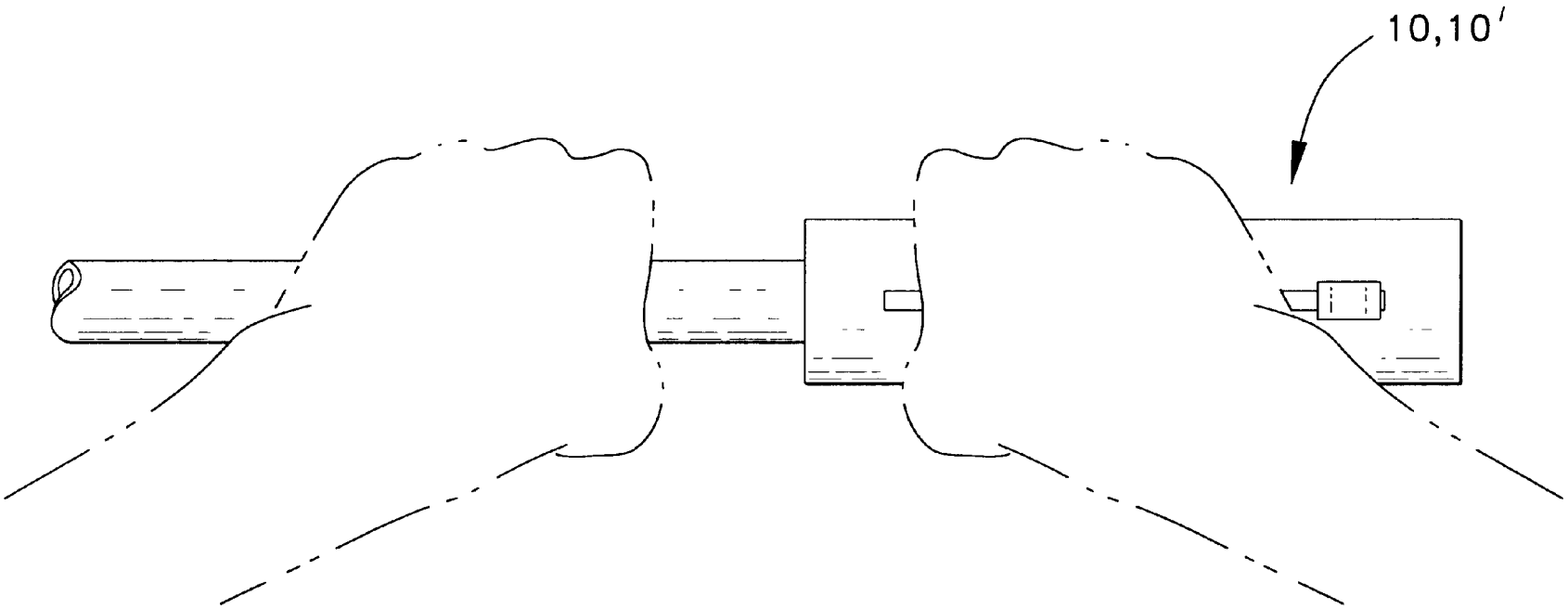
FIG. 5 is a perspective view of an embodiment of the invention in use.

The hand-held tool (10, 10') is sized to be conveniently held in one hand while the piece (tubing or fitting) to be prepared is held in the other hand, as shown in FIG. 5. The operator cleans the surfaces of the piece being prepared for soldering with the cleaning brush (16, 16') affixed to the first end 13 of the casing 11. He then dispenses the flux 28, from the cartridge 15, the dispensed flux being transmitted to the flux applicator. The operator then applies the dispensed flux from the flux applicator onto the cleaned surfaces of the tubing or the fittings being prepared for soldering.

When the piece is slid into position at the first end 13, a quick twisting motion is used to clean the piece. Similarly, a quick twisting motion is used to apply flux 28, to the cleaned end when it is inserted in the second end 14 of the tool (10, 10').

Separate tools (10, 10') are required for preparing the internal surfaces and the external surfaces of each size of the pieces (tubing and fittings) to be soldered—⅜", ½", ¾" and 1". Thus, a total of eight (8) such tools would be needed to have the capability to prepare both the internal and external surfaces of all four sizes.

However, the most common sizes are ½" and ¾". When working with ½" tubing, a plumber will only need the two tools (10, 10') for that size (½"). Similarly, when working with ¾" tubing, only the two tools (10, 10') for that size (¾") need be available. The tools, which may be conveniently carried in a small case, can be identified by visibly marking the size of each tool on the external surface of the casing 11 (e.g., ½" out and ½" in for the ½" size of tool 10 and the ½" size of tool 10').

While the invention has been described with respect to the preferred embodiment (10, 10') constructed in accordance therewith, it will be apparent to those skilled in the art that various modifications and improvements may be made without departing from the scope and spirit of the invention. For example, it will be apparent to those skilled in the art that the hand-held tool (10, 10') may be used to apply any flowable product ("flux") to the surface of a pipe or fitting. The hand-held tool (10, 10') may be used to apply different types of flowable products or coatings ("fluxes") to different types of cylindrical objects, such as fluxes to pipes and fittings for welding, brazing, glazing, and painting. Accordingly, it is to be understood that the invention is not to be limited by the specific illustrative embodiments and use of the invention is not limited to soldering applications, but only by the scope of the claims.

The present invention may be embodied in other variant forms where the variations do not substantially differentiate from the essential novelty and uniqueness revealed in the foregoing disclosure. Reference should therefore be made to the appended claims rather than the foregoing specification, as indicating the scope of the invention. It should be understood that many modifications, variations, and changes may be made without departing from the spirit and scope of the invention as defined in the claims.

What Is Claimed Is:

1. A hand-held tool for preparing the outside or inside surfaces of tubing and fittings, comprising:

an elongated casing having a longitudinal axis, first and second concave ends, and a chamber between the first and second concave ends;

a removable cartridge containing a flux and having an orifice for discharge of the flux from the cartridge, the cartridge being disposed within the chamber;

a cleaning brush disposed inside the first concave end of the casing;

dispensing means for dispensing the flux from the cartridge;

transmitting means in communication with the orifice of the cartridge for transmitting the dispensed flux from the cartridge to a flux applicator; and a flux applicator disposed inside the second concave end of the casing in communication with the transmitting means.

2. A hand-held tool for preparing the outside surfaces of tubing and fittings, comprising:

an elongated casing having a longitudinal axis, first and second concave ends, and a chamber between the first and second concave ends;

a removable cartridge containing a flux and having an orifice for discharge of the flux from the cartridge, the cartridge being disposed within the chamber;

a cleaning brush disposed inside the first concave end of the casing and adapted to clean the outside surfaces of a tubing or a fitting;

dispensing means for dispensing the flux from the cartridge;

transmitting means in communication with the orifice of the cartridge for transmitting the dispensed flux from the cartridge to a flux applicator; and a flux applicator disposed inside the second concave end of the casing in communication with the transmitting means.

3. A hand-held tool as in claim 2 wherein the cleaning brush is an annular brush having a longitudinal axis substantially parallel to the longitudinal axis of the elongated casing.

4. A hand-held tool as in claim 3 further comprising a burr-removing device for removing burrs from a tubing or a fitting, the burr-removing device being mounted inside the first concave end adjacent a portion of the annular cleaning brush nearest to the chamber.

5. A hand-held tool for preparing the inside surfaces of tubing and fittings, comprising:

an elongated casing having a longitudinal axis, first and second concave ends, and a chamber between the first and second concave ends;

a removable cartridge containing a flux and having an orifice for discharge of the flux from the cartridge, the cartridge being disposed within the chamber;

a cleaning brush disposed inside the first concave end of the casing and adapted to clean the inside surfaces of a tubing or a fitting;

dispensing means for dispensing the flux from the cartridge;

transmitting means in communication with the orifice of the cartridge for transmitting the dispensed flux from the cartridge to a flux applicator; and a flux applicator disposed inside the second concave end of the casing in communication with the transmitting means.

6. A hand-held tool as in claim 5 wherein the cleaning brush is a tubular brush having a longitudinal axis substantially parallel to the longitudinal axis of the elongated casing.

7. A hand-held tool for preparing the outside or inside surfaces of tubing and fittings comprising:

an elongated casing having a longitudinal axis, first and second ends and a chamber between the first and second ends:

a removable cartridge containing a flux and having an orifice for discharge of the flux from the cartridge the cartridge being disposed within the chamber;

a cleaning brush affixed to the first end of the casing;

dispensing means for dispensing the flux from the cartridge;' transmitting means in communication with the orifice of the cartridge for transmitting the dispensed flux from the cartridge to a flux applicator; and a flux applicator connected to the transmitting means adjacent the second end of the casing, wherein the flux applicator comprises a plurality of pads adapted to apply dispensed flux onto the surface of a tubing or a fitting.

8. A hand-held tool as in claim 7 wherein the pads are made of a flexible, porous material such as felt, woven fabric, or carpet-like nap material.

9. A hand-held tool as in claim 8 wherein the casing is substantially cylindrical and the plurality of pads comprises three (3) pads each located substantially 120° apart from the other pads relative to the longitudinal axis of the casing.

10. A method of preparing the outside or inside surfaces of tubing or fittings with a hand-held tool as in claim 7, comprising the steps of:

holding the hand-held tool;

cleaning the surface of a tubing or a fitting with the cleaning brush;

dispensing the flux from the cartridge, the dispensed flux being transmitted to the flux applicator; and applying the dispensed flux from the flux applicator onto the cleaned surface of the tubing or the fitting.

11. A hand-held tool as in claim 1 wherein the cartridge has a collapsible outer surface.

12. A hand-held tool as in claim 11 wherein the dispensing means comprises a movable member, which member when moved into contact with the collapsible outer surface of the cartridge compresses the cartridge and forces some of the flux out of the orifice and into the transmitting means.

13. A hand-held tool as in claim 12 wherein an outer circumference of the casing has a channel therein, said channel extending substantially the length of the chamber and being in communication with the chamber, and wherein the movable member comprises:

a roller disposed in the chamber; and a lever having first and second ends, the first end of the lever being attached to the roller and the second end of the lever extending through the channel to the outer circumference of the casing, the movement of the second end of the lever resulting in a corresponding movement of the roller within the chamber.

14. A hand-held tool as in claim 1 wherein the elongated casing is substantially cylindrical.

15. A hand-held tool as in claim 14 wherein an outer circumference of the casing has a planar surface over approximately 10–30% of the outer circumference, the planar surface extending at least 40% of the length of the casing substantially parallel to the longitudinal axis of the casing.

16. A hand-held tool as in claim 1 further comprising a removable cover attachable to the second end of the casing to cover the flux applicator when the flux applicator is not in use.

17. A hand-held tool for preparing the outside or inside surfaces of tubing and fittings, comprising:

an elongated casing having a longitudinal axis, first and second ends, and a chamber between the first and second ends;

a removable cartridge containing a flux and having an orifice for discharge of the flux from the cartridge, the cartridge being disposed within the chamber, a wire brush affixed to the first end of the casing;

dispensing means for dispensing the flux from the cartridge;

transmitting means in communication with the orifice of the cartridge for transmitting the dispensed flux from the cartridge to a flux applicator; and a flux applicator connected to the transmitting means adjacent the second end of the casing.

18. A held tool for preparing the outside surfaces of tubing and fittings comprising:

an elongated casing having a longitudinal axis, first and second ends and a chamber between the first and second ends;

a removable cartridge containing a flux and having an orifice for discharge of the flux from the cartridge, the cartridge being disposed within the chamber;

an annular wire brush affixed to the first end of the casing and adapted to clean the outside surfaces of a tubing or a fitting;

dispensing means for dispensing the flux from the cartridge;

transmitting means in communication with the orifice of the cartridge for transmitting the dispensed flux from the cartridge to a flux applicator; and a flux applicator connected to the transmitting means adjacent the second end of the casing.

19. A hand-held tool for preparing the inside surfaces of tubing and fittings, comprising:

an elongated casing having a longitudinal, axis first and second ends, and a chamber between the first and second ends, a removable cartridge containing a flux and having an orifice for discharge of the flux from the cartridge, the cartridge being disposed within the chamber;

a tubular wire brush affixed to the first end of the casing and adapted to clean the inside surfaces of a tubing or a fitting;

dispensing means for dispensing the flux from the cartridge;

transmitting means in communication with the orifice of the cartridge for transmitting the dispensed flux from the cartridge to a flux applicator; and a flux applicator connected to the transmitting means adjacent the second end of the casing.

20. A hand-held tool as in claim 1 wherein at least one end of the casing is removable to provide access to the chamber for insertion and removal of the removable cartridge.

* * * * *